United States Patent [19]

Stoody

[11] Patent Number: 5,004,123

[45] Date of Patent: Apr. 2, 1991

[54] FLUID DISPENSER WITH NON-VENTING ASPIRATOR AND BAG

[76] Inventor: William R. Stoody, 8659 Summerdale Rd., San Diego, Calif. 92126

[21] Appl. No.: 390,111

[22] Filed: Aug. 7, 1989

[51] Int. Cl.[5] ..... B65D 35/22

[52] U.S. Cl. ..... 222/94; 222/105; 222/107; 222/321; 222/383; 222/490; 383/35

[58] Field of Search ..... 222/92, 94, 95, 105, 222/107, 206, 209, 212, 213, 215, 320, 321, 372, 383, 386.5, 387, 131, 491, 490; 215/11.1, 11.3; 383/35, 905, 44, 46, 48

[56] References Cited

U.S. PATENT DOCUMENTS

| | | | |
|---|---|---|---|
| 2,208,201 | 7/1940 | Smith | 222/490 |
| 2,804,240 | 8/1957 | Anderson | 222/490 X |
| 3,187,960 | 6/1965 | Gorman | 222/380 X |
| 3,211,346 | 7/1965 | Meshberg | 222/263 X |
| 3,486,661 | 12/1969 | Friedrich et al. | 222/514 X |
| 4,008,830 | 2/1977 | Meshberg | 222/95 |
| 4,322,020 | 3/1982 | Stone | 222/321 X |
| 4,424,916 | 1/1984 | Pearson | 222/94 X |
| 4,457,454 | 7/1984 | Meshberg | 222/95 |
| 4,601,410 | 7/1986 | Bond | 222/92 |
| 4,844,299 | 4/1989 | Sekiguchi et al. | 222/94 |

*Primary Examiner*—Andres Kashnikow
*Assistant Examiner*—Kenneth DeRosa

[57] ABSTRACT

A non-venting fluid dispenser system, for example being a collapsible flaccid bag loosely suspended in a sleeve and exposed to atmospheric pressure. A non-venting aspirator and a pressure actuated valve are mounted on the sleeve and close the bag. Operation of the aspirator promotes a low pressure on the outward side of the valve and atmospheric pressure acting against the bag drives fluid product through the valve and into the aspirator for dispensing, whereby the bag progressively collapses as fluid is expelled. The pressure actuated valve blocks against back flow entry of air into the bag.

21 Claims, 2 Drawing Sheets

FLUID DISPENSER WITH NON-VENTING ASPIRATOR AND BAG

RELATED APPLICATION

Applicant's co-pending patent applications, Ser. No. 337,151 filed Apr. 12, 1989, and Ser. No. 390,117, filed Aug. 7, 1989 are related to the present invention.

BACKGROUND OF THE INVENTION

The present invention relates to a novel fluid product dispenser, having a manually operated piston pump aspirator, within which fluid product to be dispensed is kept free from contaminating affects of air and in readiness for dispensing regardless of the attitude in which the dispenser is held.

More specifically, this invention relates to an improved non-venting aspirator dispensing system having a collapsible bag, such as disclosed in Applicant's co-pending application Ser. No. 337,151, containing dispensable fluid product and closed by a pressure actuated elastomeric valve that opens under the influence of outwards force indirectly exerted thereon by atmospheric pressure whenever a lower than atmospheric pressure exists on the outwards side of the valve.

According to the invention, the bag progressively collapses as the product is aspirated therefrom and it remains in its collapsed state, keeping the product in dispensing readiness communication with the valve, between dispensing operations. In a closed state, the valve blocks back flow of air into the bag and thereby cooperates with atmospheric pressure acting on the exterior of the bag to hold the bag in a collapsed state whereas the product is in dispensing readiness communication with the valve. Dispensing can take place with the dispensing system held in any attitude.

Heretofore piston pump fluid dispensers, such as hand actuated trigger and finger depressible push button piston pump spray apparatus, have required a venting passage from atmosphere into the interior of the fluid product container in order for fluid to be withdrawn. An air space exists above the fluid, and a dip tube is needed to reach fluid at the lower most region of the fluid container.

Thus, existing dispensers are required to be held in a generally upright position, for dispensing, which is often an inconvenience to the user since the dispensers are restricted from upwards and downwards spraying, particularly after a substantial portion of the fluid has been expended.

Piston pump dispensing systems have heretofore required venting in order to function. Piston pumps function by creating, within a pump chamber, a low pressure (less than atmospheric pressure) and atmospheric pressure acting on the surface of the fluid drives the fluid into the pump chamber via the dip tube and a check valve. This function typically takes place on the return or release stroke, of a piston that is within the pump chamber, which follows a dispensing stroke. On the dispensing stroke the check valve closes causing the fluid to be driven from the piston chamber, through a piston chamber outlet, under pressure.

The elastomeric valve of the present invention is provided, in addition to a piston pump check valve, to seal against back flow of air into the collapsible bag via the piston chamber due to low negative pressure effect of gravity acting on fluid within the bag. The check valve, which is generally a loose ball, does not effectively seal against such back flow.

The present invention clearly advances the art of piston pump fluid dispensers and even more, it is a novel non-venting dispensing system that overcomes heretofore adversities of piston pump fluid dispensers. It enables dispensing in any direction, without regard to the dispensing attitude, and it extends product freshness by keeping air away from product awaiting dispensation.

SUMMARY OF THE INVENTION

There is a need for a simple, piston pump fluid dispenser that holds the product in a ready state for dispensing and facilitates dispensing of the product without regard to attitude.

The primary objective of the present invention is to satisfy that need by combining a common piston pump aspirator with a collapsible flaccid bag, for isolated containment of the fluid product, having a passive guide means that manages collapsing of the bag to insure that complete emptying of the bag will not be impeded.

Another objective is to provide a fluid dispenser, as stated in the foregoing objective, having a pressure actuated valve that facilitates aspiration of fluid and blocks entry of air into the bag.

Another objective is to provide a fluid dispenser, as stated in the foregoing objectives, that facilitates dispensing of fluid in any direction.

Another objective is to provide a fluid dispenser as stated in the foregoing objectives, having a reusable piston pump aspirator.

Still another objective is to provide a fluid dispenser as stated in the foregoing objectives, that accommodates use of replaceable prefilled bags.

An additional objective is to provide a closed non-venting fluid dispenser having a collapsible squeeze tube for containment of fluid product.

These and other objectives will be seen from the following specifications and claims in conjunction with the appended drawing.

THE DRAWING

DETAILED DESCRIPTION OF THE INVENTION

Specific terminology resorted to in describing the illustrated embodiments of the present invention is not intended to be limiting. It is understood that this is for clarity and includes all technical equivalents which function in a similar manner to accomplish a similar purpose or result. Well known variations of finger operated aspirators, including resilient squeeze bulb suction pumps, are contemplated to be inclusive in the present invention.

Figure 1:
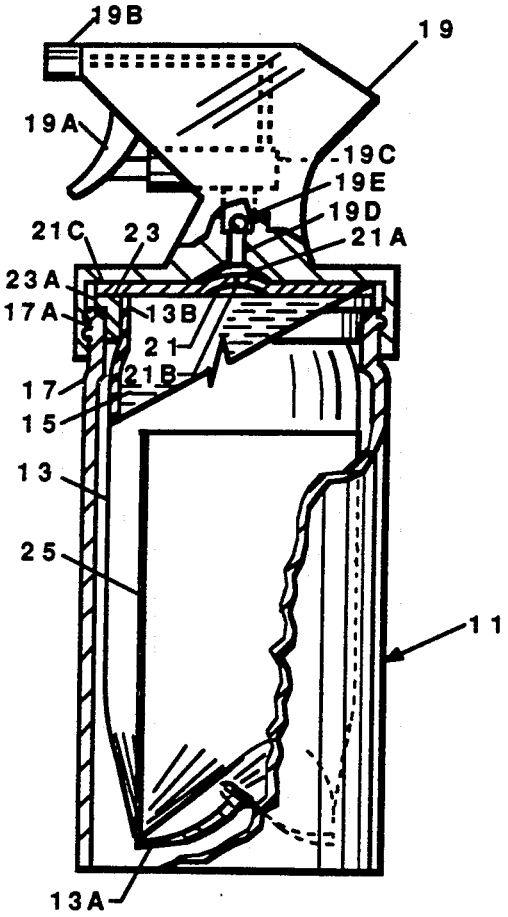
FIG. 1 is a longitudinal view of a non-venting trigger piston pump aspirator dispensing system, of the present invention, having wall portions broken away for illustrative purposes.

Referring to the drawing, particularly FIG. 1, shown therein is a preferred embodiment of a portable non-venting fluid dispensing system 11. Said dispensing system includes; a collapsible flaccid bag 13 containing dispensable fluid product 15, a holder sleeve 17, a non-venting trigger piston pump aspirator 19, and a normally closed pressure actuated valve 21.

Holder sleeve 17 is cylindrical, it has an open distal end and an externally threaded open upper end 17A to accommodate mounting of said aspirator. Said sleeve may be constructed from plastic, glass, metal, or any other moisture resistant material, for example, resin impregnated card board, and the sidewalls may be provided with decorative shaped openings (not shown). The primary purpose of said sleeve is to provide a convenient handling and standing means for said dispensing system. Other shapes are equally suitable.

The bag, which is shown in a filled (expanded) state, is preferably constructed from a length of cylindrical thin wall compliant plastic tubing that is heat sealed closed at its distal end, designated 13A. The opposite end, designated 13B is open and provided with an annular fitment 23 having a circumferential flange 23A that overlies and engages the open end of said sleeve, and the bag is suspended loosely inside of said sleeve. Said fitment is sealingly joined to said open end by bonding or other suitable means.

Disposed on said bag is a passive guide means 25 that influences the collapsing configuration of said bag. Guide means 25 is a thin rectangular sheet of resilingly complaint plastic that is laminated to a surface portion of said bag. A thin panel of cellophane (not shown), loosely inserted inside of said bag, is a suitable alternative to guide means 25.

The guide means manages collapsing of the bag by negating adverse resistances produced by bag wrinkles and enhancing propitious resistances, without compromising the attributes of the bag. And in so doing, the passive guide means prevents the proliferation and sustainment of fluid retention pockets that normally proliferate inside of flaccid bags, as the bags collapse, and block complete emptying of the bags. Said guide means and said fitment are integral members of the bag.

Valve 21 is a disc shape elastomeric component having a centrally located, upwardly projecting, concavo-convex bulge 21A having a transverse valvular slit 21B. A planar flange 21C, having a circumference that is approximately equal to circumference of said fitment flange, radially continues from said bulge. The valve is sealingly disposed on and closes the open end of said bag, and the bag and valve are retained in place relative to said sleeve by said trigger piston pump which is secured to the threaded end of said sleeve in a conventional manner. Air tight closure of said bag is required for proper collapsing of said bag.

To produce the valvular slit, the bulge is desirably held in a stretched state while a transverse cut through apex of the bulge is made. Thus, facing surfaces 21D and 21E, shown parted in FIG. 2, of the slit are naturally biased together in a closed state, by elasticity of the valve.

Figure 2:
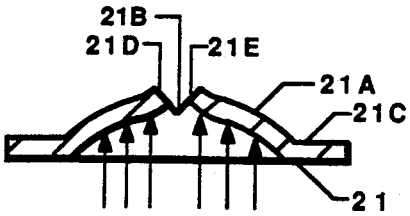
FIG. 2 is a cross sectional view illustrating the pressure actuated valve in an open state.

For dispensing, see FIG. 2, the bulge stretches outwardly and enlarges in response to outwards pressure (represented by arrows) exerted against the concave surface of the bulge. This stretching causes facing surfaces, 21D and 21E, of the slit to part whereby the valve is in an open state. When exertion of pressure is halted the valve resilingly returns to its normally closed state, whereby the opposing surfaces of the slit tend to tighten together. In said normally closed state, the bulge and valvular slit act together to resist against outward flow of fluid product from said bag, and to block inwards flow (back flow) into said bag.

Figure 3:
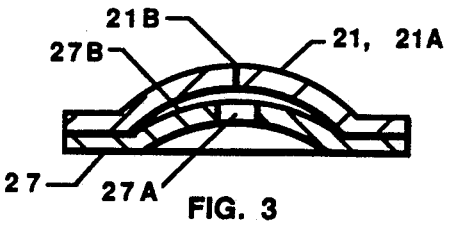
FIG. 3 is a cross sectional view similar to FIG. 2, illustrating the pressure actuated valve in a closed state and a means for preventing inversion of the valve.

A valve support 27, shown in FIG. 3, is provided as an option for reinforcement of the valve to prevent inversion of the bulge. Said support is substantially a rigid and has a disc shape, conforming to the shape of said valve, and an aperture 27A centrally located in an upwardly convex center portion 27B that is nested beneath said valve bulge. The primary purpose of support 27 is to ensure against inversion of the valve bulge in dispenser applications where back flow pressure against the valve is substantial, it is not needed for applications where back flow pressure is light.

Said aspirator is basically a conventional piston pump device of substantial prior prior art having a trigger 19A that provides an operating means and an adjustable nozzle 19B for discharge of fluid product, and it is provided with a piston chamber 19C, an inlet passage 19D containing a ball check valve 19E that closes against back flow of fluid product, therefore except as necessary to describe modifications that are needed to facilitate use of the pump, the pump will not be described in any greater detail than necessary.

The two most significant differences between pump 19 and conventional trigger pumps are, that a conventional dip tube (not shown) and vent means (not shown) which are required for conventional pumps have been eliminated. The dip tube is not needed because the bag collapses holding the fluid product in dispensing readiness communication with valve 21, whereas fluid product passes directly through valve 21 and into a piston chamber 19C via passage 19D and ball check valve 19E on the release stroke of the trigger following squeezing of the trigger for dispensing.

Elimination of the vent means is necessary, for the dispensing system of this invention, for functional reliability. Piston pumps function on a vacuum principle whereas, on the release stroke of the trigger, a low pressure (less than atmospheric pressure and generally referred to as a vacuum) is created in the piston chamber, and because of this low pressure atmospheric pressure acting on the contained fluid product drives the fluid product toward the low pressure source until the pressure at the source is equalized with pressure acting on said contained fluid. Said fluid passes through valve 21 and is drawn into a piston chamber 19C via passage 19D and ball check valve 19E on the release stroke of the trigger following squeezing of the trigger for dispensing. Therefore, venting into said bag or said passageway would have an adverse effect because air, being at atmospheric pressure above the fluid, instead of fluid product would enter the piston chamber.

Atmospheric pressure uniformally acts against the bag causing the fluid product contained therein to constantly be under pressure which consequently exerts outwards pressure against said valve causing valve 21 to open whenever a low pressure is created on the outward side of valve 21. This promotes dispensing of the fluid product regardless of the attitude of the dispensing system, and the bag correspondingly collapses occupying space vacated by the discharged fluid product.

Dispensing may be repeated so long as the bag contains fluid to be dispensed. And, since valve 21 blocks against back flow, the bag remains collapsed between dispensing operations and thereby keeps the remaining fluid in dispensing readiness communication with valve 21 regardless of the attitude of said dispensing system.

Figure 8:
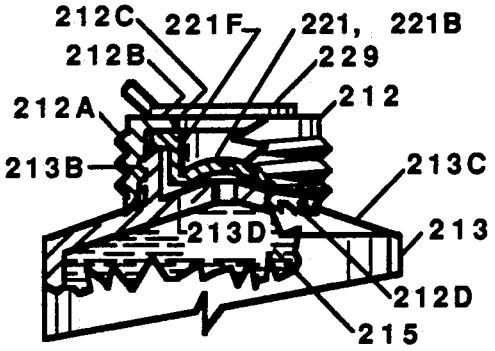
FIG. 8 is a fragmentary view which illustrates a prefilled bag having a closure means that is adapted for attachment of a piston pump aspirator.

It is to be understood that the bag may be either prefilled with dispensable fluid product or empty prior to placement into said sleeve. For a prefilled bag a peel off closure foil (not shown), such as closure foil 229 shown in FIG. 8, is provided over the open end of the bag, either beneath or covering the valve. The closure foil is removed, or pierced by the product user, prior to first use of the dispensing system. An empty bag merely requires conventional filling with dispensable fluid product whenever it is convenient to do so.

MODIFICATION

In describing this modification, whenever practical, features and entities that are like or similar to those previously described are designated with numbers that respectively have the same last two digits as those numbers used in the foregoing described embodiment. Generally descriptions of features, functions and entities hereintofore described will not be repeated in any greater depth than necessary.

Figure 4:
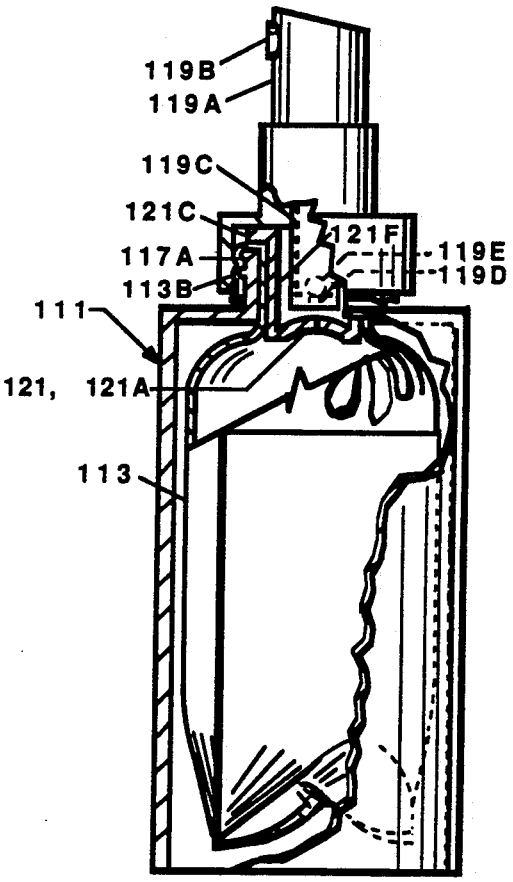
FIG. 4 is a longitudinal view of a non-venting push button piston pump aspirator dispensing system, of the present invention, having wall portions broken away for illustrative purposes.

Shown in FIG. 4 is an alternative non-venting piston pump fluid dispensing system 111. This dispensing system also includes; a collapsible flaccid bag 113 for containment of dispensable fluid product, a holder sleeve 117, a non-venting piston pump 119, and a normally closed pressure actuated valve 121.

For dispensing system 111 fitment 23, previously described, has been deleted and open end 113B of bag 113 is turned back and conformingly drawn down over externally threaded necked end 117A of sleeve 117. Valve 121 is sealingly disposed in and closes the open end of said bag, and the bag and valve 121 are retained in place relative to said sleeve by push button piston pump 119 which is secured to the threaded end of said sleeve in a conventional manner, compressing valve flange 121C in air tight engagement with the turned back open end of said bag.

Push button piston pump 119 is analogous with pump 19, the major difference is that operating means (trigger) action of pump 19 is in a direction perpendicular to the axis of the dispensing system whereas the operating means action direction of pump 119 is along the axis of dispensing system 111. And the operating means for pump 119 is a push button designated 119A which includes a nozzle 119B. Pump 119 is a conventional push button piston pump, of substantial prior art, which is modified by elimination of the dip tube and vent means for the hereintofore stated reasons.

Valve 121 is also analogous with valve 21, the only difference is that valve 121 has a cylindrical wall 121F that spaces flange 121C above bulge 121A so that bulge 121A is recessed into the open end of the bag. Recessing of the bulge is necessary to accommodate the pump piston chamber designated 119C which extends downwardly, in a conventional manner beneath the head structure portion of the pump, and includes passage 119D.

Valve support 27 has been omitted, otherwise all aspects of dispensing system 111 are as hereintofore described in reference to fluid dispensing system 11. Also instead of being disposed in passage 119D check valve 119E, which closes against back flow of fluid product through passage 119D, is conventionally situated within piston chamber 119C.

MODIFICATION

In describing this modification, whenever practical, features and entities that are like or similar to those previously described, in reference to FIG. 1, are designated with numbers that respectively have the same last two digits as those numbers used in the foregoing description. Generally descriptions of features, functions and entities hereintofore described will not be repeated in any greater depth than necessary.

Figure 5:
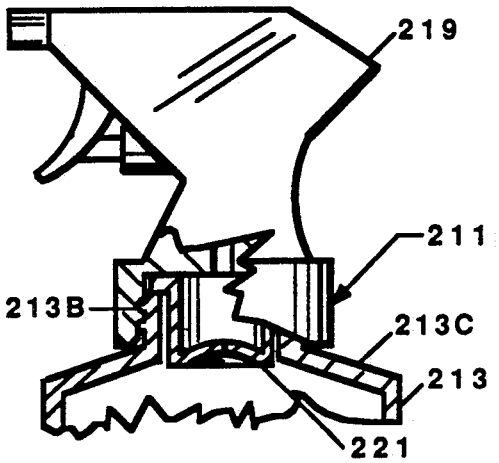
FIG. 5 is a fragmentary view similar to FIG. 1, which illustrates a fluid dispenser having a non-venting trigger pump aspirator disposed on a squeeze tube.

Shown in FIG. 5 is an alternative non-venting piston pump fluid dispensing system 211. This dispensing system also includes; a collapsible bag 213 for containment of dispensable fluid product, a non-venting trigger piston pump 219, and a normally closed pressure actuated valve 221 which is similar to valve 121 shown in FIG. 4.

The primary difference between dispensing system 219 and 19 is that the previously described holder sleeve has been deleted. Bag 213 is better defined as being a squeeze tube because it is constructed of a relatively heavy compliant material and it is provided with a relatively stiff circular shoulder 213C and an externally threaded open end neck 213B at its upper most end.

Such squeeze tubes are common and often used for dispensing toothpaste and cosmetic creams, and they are not in the flaccid bag category. Said trigger piston pump 219 is attached directly to neck 213B, holder sleeve 17 described in reference to FIG. 1 is not needed for this dispensing system therefore has been deleted.

Figure 7:
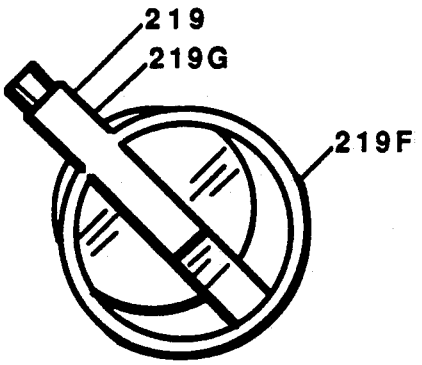
FIG. 7 is a plan view taken in the general direction of arrow lines 7—7 of FIG. 6, to better illustrate the stand means.
Figure 6:
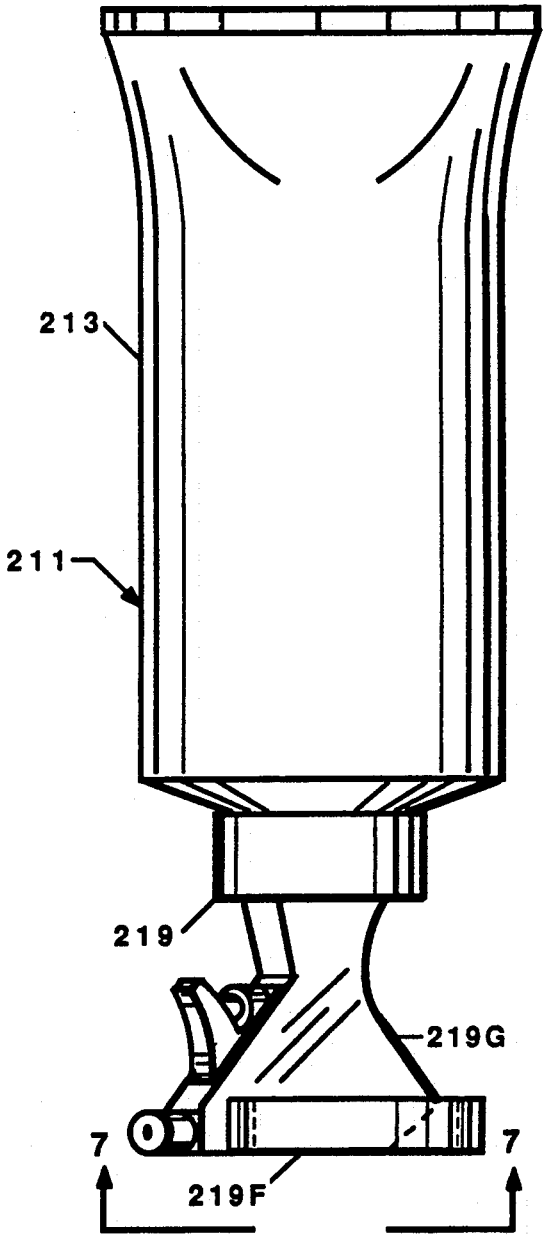
FIG. 6 is a side view of a fluid dispenser, having a stand means, in an upside down standing position.

However, in eliminating the holder sleeve the means for standing the dispensing system in storage is thereby eliminated. Therefore, trigger piston pump 219 is further modified, as seen in FIGS. 6 and 7 in a slightly rotated position, to include a stand means 219F which is simply a horizontal ring that is joined to the head structure 219G of said pump, as best seen in FIG. 7, and forms an integral member of said head structure. Said stand means may be molded in place, bonded or attached by any other suitable means. This ring is situated so that it provides, in conjunction with said head structure, a stable base and allows the dispensing system to be stood in an upside down position or hung upright from a conventional storage wall hook. Said standing means is optional, it is not necessary for operation of this fluid dispenser.

Shown in FIG. 8, is a further modified bag 213 which is provided with an annular upwardly convex ledge 213D in the open end neck 213B of said bag. Said ledge is an annular continuation of shoulder 213C and it is situated such that it is nested upwardly beneath the concave under side of valve bulge 221B. The cylindrical wall 221F, which extends the bulge downwardly, is of a length that suitably accommodates said ledge. This ledge is analogous with valve support 27, its function is to ensure against inversion of the valve bulge.

Also shown in FIG. 8 bag 213 is prefilled with fluid product 215 and provided with a tamper resistant closure 212, which is basically an aperture cap having a circular upright wall 212A which is internally and externally threaded and continuously joined to a top closure surface 212B having a centrally located aperture 212C. Said bag closure is mounted onto and in threaded engagement with neck 213B of said bag, and sealingly secures valve 221 in place in the neck opening. A peel off closure foil 229 is sealingly disposed on the top of said bag closure, so that the aperture is closed. The peel off foil may alternatively be pull off tab formed as an integral tear away portion of said closure.

Wall 212A is provided with a saw-toothed bottom brim 212D having downwardly projecting pointed teeth, that bite into shoulder 213C, which are slanted in a counterclockwise direction. Said brim resists untwisting removal of closure 212 from the bag, and together with the peel off foil provides a tamper resistant closing means for said prefilled bag.

The tamper resistant closure means is provided as an option to for replaceable prefilled bags to facilitate reuse of the piston pump with replacement prefilled bags. For attachment of the piston pump, to the bag, the peel off foil is first removed to open said aperture and the pump (not shown) is simply mounted in place, in screw thread engagement with the external threads of closure wall 212A.

It should be understood that it is both ecologically and economically desirable to provide a dispensing system that minimizes unnecessary disposal of plastic materials, pumps are typically made of a plastic material that take many years to decompose, and they are very costly due to their complexity and the high cost of plastic raw material. Therefore it is highly desirable to provide a safe dispensing system that facilitates reuse of the pump.

All other aspects of dispensing system 211 are as hereintofore described in reference to dispensing system 11.

It is believed to be self evident that the valve 21 may be molded in place (not shown) in said bottle closure, using liquid silicone or other resilient material, whereas said bottle closure is an integral part of said valve.

It is further believed to be self evident that sealant or gasketing (not shown) may be provided to provide air tight closure of the bag open end.

And it is also thought to be self evident that an elastomeric valve or a functionally equivalent valve means may be provided as a component of piston pumps, whereas, the elastomeric valve described herein may be omitted.

Having described my invention, reference should now be had to the following claims.

I claim:

1. A portable non-venting pump fluid dispenser system for isolated containment and dispensing of fluid product, which comprises:

a collapsible bag, for containment of said fluid, having an open upper end and a closed distal end;

a finger operated non-venting pump, having an inlet check valve which closes against back flow of fluid product, which facilitates said dispensing and closes said dispenser system;

and a valve means which blocks back flow of air into said bag being disposed between said check valve and interior of said bag.

2. In the invention of claim 1, said bag being a flaccid bag.

3. In the invention of claim 1, said bag being a collapsible squeeze tube.

4. A portable non-venting aspirator fluid dispenser for isolated containment and dispensing of fluid product, which comprises:

a collapsible bag, for containment of said fluid, having an open upper end and a closed distal end;

a finger operated non-venting aspirator, having an inlet check valve which closes against back flow of fluid product, which facilitates said dispensing and closes said dispenser;

and a differential pressure actuated valve means which blocks back flow of air into said bag, being disposed between said check valve and interior of said bag;

said differential pressure being a low pressure created in said aspirator, outwards of said valve means, and a high pressure being outwards pressure exerted against said valve means, whereas the source of said high pressure being such as atmospheric pressure acting on said bag.

5. In the invention of claim 4, said valve means being of an elastomeric material and having a concavo-convex bulge;

a transverse slit being provided in said bulge, and said slit providing facing surfaces which resist outwards flow of fluid and block against inwards flow into said bag.

6. In the invention of claim 4, said aspirator having a standing means, which facilitates standing said fluid dispenser in an upside down position, affixed thereto.

7. In the invention of claim 4, said bag being a flaccid bag.

8. In the invention of claim 4, said bag being a collapsible squeeze tube.

9. A portable non-venting aspirator fluid dispenser system for isolated containment and dispensing of fluid product, which comprises:

a collapsible flaccid bag, for containment of said fluid, having an open upper end and a closed distal end;

a finger operated non-venting aspirator, having an inlet check valve which closes against back flow of fluid product, which facilitates said dispensing and closes said dispenser system;

and a valve means which blocks back flow of air into said bag, being disposed between said check valve and interior or said bag.

10. In the invention of claim 9, said bag being loosely suspended in inside of a holder sleeve having an externally threaded open end;

said valve means and said bag being retained in place relative to said sleeve by said aspirator being secured to said sleeve end.

11. In the invention of claim 9, said valve means being of an elastomeric material and having a concavo-convex bulge;

a transverse slit being provided in said bulge, and said slit providing facing surfaces which resist outwards flow of fluid and block against inwards flow into said bag.

12. In the invention of claim 9, a valve support which prevents inversion of said bulge being nested beneath said valve.

13. In the invention of claim 9, said bag being prefilled with fluid and having a closure means.

14. A portable non-venting aspirator fluid dispenser for isolated containment and dispensing of fluid product, which comprises:

a collapsible bag, for containment of said fluid, having an open upper end and a closed distal end;

a non-venting trigger piston pump, having an inlet check valve which closes against back flow of fluid product, which facilitates said dispensing and closes said dispenser;

and a differential pressure actuated valve means which blocks back flow of air into said bag, being disposed between said check valve and interior of said bag;

said differential pressure being a low pressure created in said aspirator, outwards of said valve means, and a high pressure being outwards pressure exerted against said valve means, whereas the source of said high pressure being such as atmospheric pressure acting on said bag.

15. In the invention of claim 14, said bag being a flaccid bag.

16. In the invention of claim 14, said bag being a collapsible squeeze tube.

17. In the invention of claim 14, said bag being prefilled with fluid and having a closure means.

18. A portable non-venting aspirator fluid dispenser for isolated containment and dispensing of fluid product, which comprises:

a collapsible bag, for containment of said fluid, having an open upper end and a closed distal end;

a non-venting push button piston pump, having an inlet check valve which closes against back flow of fluid product, which facilitates said dispensing and closes said dispenser;

and a differential pressure actuated valve means which blocks back flow of air into said bag, being disposed between said check valve and interior of said bag;

said differential pressure being a low pressure created in said aspirator, outwards of said valve means, and a high pressure being outwards pressure exerted against said valve means, whereas the source of said high pressure being such as atmospheric pressure acting on said bag.

19. In the invention of claim 18, said bag being a flaccid bag.

20. In the invention of claim 18, said bag being a collapsible squeeze tube.

21. In the invention of claim 18, said bag being prefilled with fluid and having a tamper resistant closure means.

* * * * *